United States Patent [19]

Pierce

[11] 4,201,375

[45] May 6, 1980

[54] FIREWOOD CUTTING AID

[76] Inventor: Everett T. Pierce, R.F.D., Clare, Iowa 50524

[21] Appl. No.: 565

[22] Filed: Jan. 2, 1979

[51] Int. Cl.[2] ..... B66C 23/60

[52] U.S. Cl. ..... 269/46; 254/139.1; 269/53

[58] Field of Search ..... 254/139.1, 139, 88, 254/99; 269/296, 46, 53, 130–132, 289 R; 182/154–155, 181–186, 225–227; 144/193 A

[56] References Cited

U.S. PATENT DOCUMENTS

| | | | |
|---|---|---|---|
| 1,001,272 | 8/1911 | Howard | 144/193 A |
| 1,432,998 | 10/1922 | Grau | 269/53 |
| 2,719,696 | 10/1955 | Palka | 254/99 |
| 2,760,756 | 8/1956 | Lucker | 254/99 |
| 3,433,277 | 3/1969 | Ribley | 269/296 |
| 3,716,216 | 2/1973 | Kirkpatrick | 254/139.1 |

*Primary Examiner*—Robert C. Watson

*Attorney, Agent, or Firm*—Zarley, McKee, Thomte, Voorhees & Sease

[57] ABSTRACT

A log cutting aid comprising an inclined skid member, which is preferably a single skid member and cylindrical in shape, having forward and rearward ends, a foot support at its forward end, preferably adapted for sliding engagement with the bottom surface of a log, support means adjacent the rearward end of said skid member to hold said skid member in an inclined position, and winching means attached to said skid near its rearward end for engaging logs and winching the same up onto said skid in a direction from the forward end toward the rearward end. Logs held on the skid may then be conveniently cut with a chain saw or the like.

9 Claims, 3 Drawing Figures

FIREWOOD CUTTING AID

BACKGROUND OF THE INVENTION

In this day and age of fuel conservation more and more people are turning to fireplaces, wood burning stoves, and other wood burners as either an aid to heating or as a total replacement for other heating means, such as natural gas or the like.

Increased demand for heating by wood burning has, of course, increased the demand for firewood. There is, therefore, a continuing need for large supplies of precut firewood which may be supplied to users of wood burning devices.

Perhaps the most common means of cutting such firewood is by use of chain saws. However, large logs which have been cut and are lying on the ground are not easily precut into fireplace sized portions when lying flat upon the ground.

For example, while chain saws are the quickest and easiest means of providing precut firewood of a size which is usable in wood burners, when the logs are to be cut are lying on the ground, the use of a chain saw is difficult. For example, if a chain saw operator is cutting a log which is directly lying on the ground, it is difficult to cut completely through the log. Moreover, if one does successfully cut completely through the log, the chain saw often cuts into the ground itself which is, of course, undesirable in that it is not only time consuming, but also tends to quickly dull and damage the chain saw.

Additionally, log cutting is usually done at an out-of-the-way remote site some distance from machinery which can be conveniently used as an aid. Indeed, oftentimes, a woodcutter finds himself with nothing more than the chain saw as his only tool at the cutting site.

This invention has as its primary object the provision of a log cutting aid which is portable, lightweight and of sturdy construction, and which can be conveniently moved from cutting site to cutting site.

Yet another object of this invention is to provide a log cutting aid which can be rapidly and easily used by a single operator to elevate logs to an inclined position for quick and easy cutting with a chain saw, thus avoiding potential problems with use of the saw.

An even further object of this invention is to provide a portable log cutting aid which allows a woodcutter to efficiently and quickly cut more logs than he otherwise might be able to.

The means and method of accomplishing these and other objects of the invention will become apparent from the detailed description which will follow.

SUMMARY OF THE INVENTION

Figure 1:
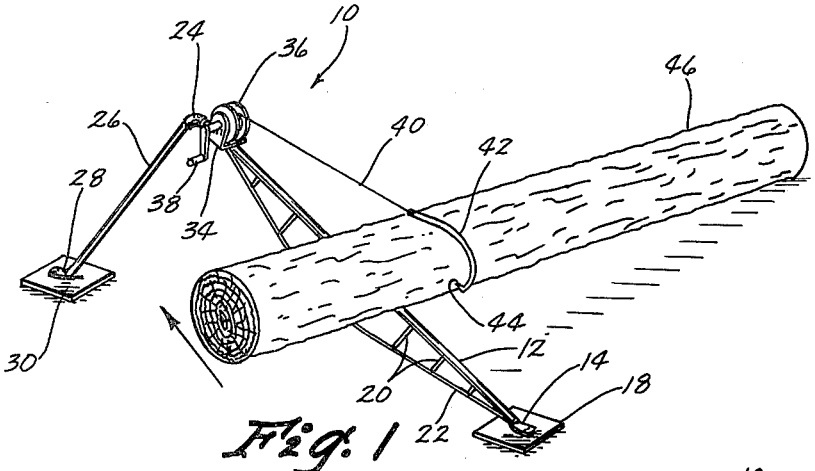
FIG. 1 is a perspective view of the device showing a log engaged by the device and ready for cutting.
Figure 2:
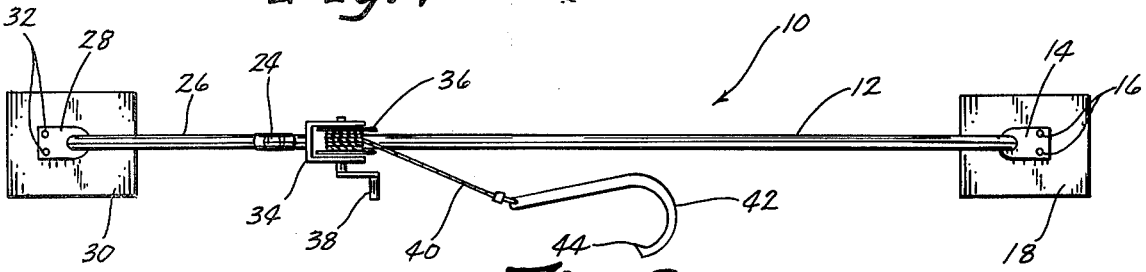
FIG. 2 is a plan view of the device of this invention.

This invention relates to a portable, but yet sturdy, log cutting aid which can be conveniently moved from job site to job site. The device employs a single inclined skid member having forward and rearward ends. The forward end of the skid member has a foot used as a ground support means and also used for wedging the skid member underneath a log which is to be cut. A winch is provided on the inclined skid member near its rearward end, and a cable is attached to the winch having at the forward end of the cable a hook means for engaging logs. The logs are winched up to a midway position on the inclined skid where they are held for cutting.

DETAILED DESCRIPTION OF THE INVENTION

A log cutting aid device 10 is comprised of a single skid member 12 which as can be seen from the drawings is mounted in an inclined position.

The skid 12 has a forward foot 14 which is mounted via conventional fastening means such as rivets 16, to a forward foot support plate 18.

A preferred and important feature of this invention is that the device itself only employs a single skid 12. This is important for portability of the unit, convenience of use, and economics of construction. Preferably the skid 12 is a cylindrical portion of 1¼ inch or one inch galvanized pipe. It has been found that use of such pipe will provide a very satisfactory upper skid surface which engages the logs. The skid surface being cylindrical in shape presents an upper arcuate surface which engages the logs and provides a minimum of contact with the log surface. In this manner, since contact between the log and the upper surface of skid 12 is minimized, drag and friction are reduced to their minimum possible levels.

The bottom surface of skid 12 is braced to prevent heavier logs from possibly bending the inclined skid 12. The bottom surface has a plurality of downwardly extending brace members 20 welded at one end to the bottom of skid member 12 and at their opposite end to bowed bracing bar 22. It has been found that when bracing of the particular construction shown and described herein is employed, skid member 12 may hold a surprising amount of weight in comparison with its own structure. It is believed that the bowed bracing arrangement mentioned herein is the reason for this increased sturdiness.

Elbow joint 24 is attached at the rearward end of skid member 24. Elbow joint 24 is of conventional pipe fitting construction and may be threadably attached to the rearward end of skid 12, or attached by any other convenient fastening means. As can be seen from the drawings, elbow joint 24 is a 90° elbow.

Leg 26 is attached to the end of elbow 24 opposite the end attached to skid 12 by similar means as those previously described with respect to skid 12. Leg 26 extends downwardly to rear foot 28 which is attached to a rear support plate 30 via fasteners 32.

It can therefore be seen that skid 12 is held in an inclined position by leg 26. In an alternative construction, the long length of galvanized piping, such as that previously described, may be bent at a right angle at a position corresponding to the elbow joint 24, and a single piece of piping may be used for skid member 12 as well as leg 26. The use of either a single member or dual elbow jointed members is a matter of choice in construction.

Figure 3:
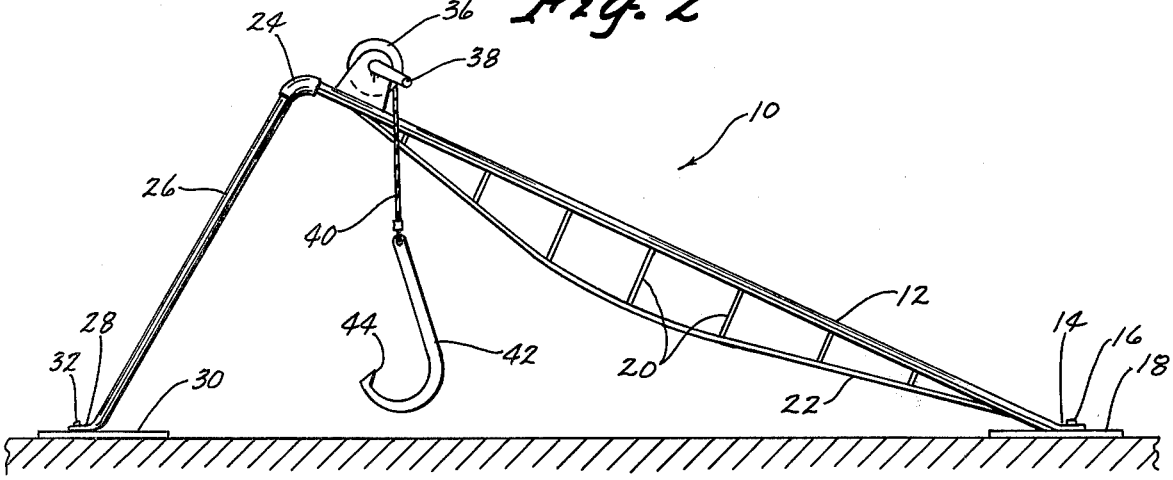
FIG. 3 is an elevated side view of the device of this invention.

An additional alternative, not specifically shown in the drawings but often desirable to enhance portability is that a locking hinge may be employed on leg 26 just below elbow 28 in order to allow leg 26 to be releasably secured in a rigid position such as shown in FIG. 3, and, when the locking hinge is disengaged, folded inwardly towards the bottom of skid member 12. This even further decreases bulkiness and enhances portability. Since such releasable locking hinges are well known, and the construction of the hinge itself does not form a part of this invention, it is not specifically shown in the drawings. It is, however, to be understood that such a hinge is contemplated as a part of this overall invention when used.

Mounted to the top of skid 12 adjacent its rearward end is a U-shaped bracket 34 which may be welded thereto or attached by other conventional means. Bracket 34 rotatably supports winding drum 36 which is attached to crank arm 38. Thus, winding drum 36 may be rotated by turning crank arm 38. One end of cable 40 is attached to winding drum 36. At the opposite end of cable 40 is a log engaging hook 42. It is preferred that hook 42 has an inwardly and upwardly projecting tooth 44 for rigidly securing log 46. Tooth 44 insures that log 46 will not roll out from under hook 42 after secured engagement therewith.

In actual operation, the device is used as follows: The log cutting device is taken to the cutting site. A log 46 which is sitting on the ground and ready for cutting, is approached and forward or front support plate 18 is wedged between the log and the ground. Rear foot plate 30 is placed firmly against the ground, and cable 40 is unwound and placed over the top of log 46. Hook 42 and tooth 44 are securely engaged with the side of log 46 in the manner depicted in FIG. 1. Crank arm 36 is rotated and log 46 is pulled to the midway position shown in FIG. 1. In this manner, the bottom of log 46 is inclined upwardly from the ground and the log may be conveniently cut into sections without any interference. The unit, of course, may be moved from log to log and may be moved for further adjustment with respect to any single log of unusual length.

Certain features of the operation of the unit are worthy of specific mention. Forward plate 18 not only functions to steady the device against lateral movement, in combination with rear foot plate 30, but forward plate 18 also effectively functions as a wedge in order to ready the device for use. Employment of only a single cylindrical skid member 12 allows minimum contact between the log and its arcuate surface which reduces drag and friction and allows for lifting of the log by the unit with a minimum of such drag and friction and a minimum of force. Load bracing member 22 allows the unit to rigidly support even large logs without danger of bending skid member 12. The weight of the log 46 coupled with support platforms 18 and 30 tend to prevent lateral movement of the device. Rear platform 30 is large enough that if the unit tends to rise during use with larger logs, the operator of crank arm 38 may stand on platform 38 in order to prevent this tendency. Hook 42 and tooth 44 are of such construction that they prevent logs 46 from rolling outwardly and away during the winding operation. It can therefore be seen that a simple, yet sturdy device is provided which accomplishes at least all of the stated objects of the invention.

What is claimed is:

1. A portable log handling device comprising, an inclined skid member which is cylindrical in shape and provides an arcuate top surface which minimizes contact with logs which are to be lifted and slid up on said skid said skid having forward and rearward ends, the angle of incline being such that logs may be slid upon said skid, such that the weight of said logs tends to hold said skid in position, bracing mounted on said skid underneath the surface of said skid which engages logs, a foot support at its forward end, and support means adjacent its rearward end to hold said skid in an inclined position, a winching means attached to said skid near its rearward end for engaging logs and winching the same upon said skid to a midway position between the forward and rearward ends of said skid.

2. The device of claim 1 wherein the foot support at the forward end of said skid is adapted to provide a wedging means for wedging between the ground and a log laying on the ground.

3. The device of claim 1 wherein said support means adjacent the rearward end of said skid is a leg support extending downwardly from the top of said skid to a ground engaging position.

4. The device of claim 3 wherein said leg member has at its bottom end a ground engaging foot support platform which is of sufficient size to stabilize the unit from lateral movement during use, and which is sufficiently large to allow an operator to stand thereon.

5. The device of claim 1 wherein said winching means comprises a winding drum rotatably mounted on said skid member near its adjacent end, and a cable means attached to said drum at one end and a hook fastener attached to the other end of said cable means.

6. The device of claim 5 wherein said hook means is a hook having at least one log engaging tooth.

7. The device of claim 4 wherein said skid member and said leg are integrally formed as a single unit.

8. The device of claim 7 wherein said skid member and said leg are formed from cylindrical galvanized pipe having a diameter of from about one to about 1¼ inches.

9. The device of claim 1 wherein said bracing is a plurality of spaced apart brace members extending downwardly from the undersurface of said skid member, each of said members being joined together by a bowed bracing bar which joins said skid member near its forward end and near its rearward end.

* * * * *